United States Patent [19]

Bedzyk et al.

[11] Patent Number: 5,031,894

[45] Date of Patent: Jul. 16, 1991

[54] FILM SHEET REGISTRATION MECHANISM

[75] Inventors: Mark D. Bedzyk, Rochester; Roger S. Brahm, Canadaigua, both of N.Y.

[73] Assignee: Eastman Kodak Company, Rochester, N.Y.

[21] Appl. No.: 516,992

[22] Filed: Apr. 30, 1990

[51] Int. Cl.[5] ..... B65H 9/00

[52] U.S. Cl. ..... 271/240; 271/248; 271/250; 271/270

[58] Field of Search ..... 271/239, 240, 248, 250, 271/251, 253, 269, 270, 271, 272, 161, 223, 238; 498/345.1

[56] References Cited

U.S. PATENT DOCUMENTS

| | | | |
|---|---|---|---|
| 1,833,027 | 11/1931 | L'Enfant | 271/248 |
| 2,756,113 | 7/1956 | Greenwood . | |
| 2,938,723 | 5/1960 | Paulson | 271/250 |
| 3,001,787 | 9/1961 | Socke . | |
| 3,206,042 | 9/1965 | Peterson . | |
| 3,588,090 | 6/1971 | Huston et al. | 271/240 |
| 4,211,399 | 7/1980 | McGowan et al. | 271/232 |
| 4,245,831 | 1/1981 | Michatek | 271/171 |
| 4,538,801 | 9/1985 | Pelt | 271/251 |
| 4,637,602 | 1/1987 | Gavaghan | 271/248 |
| 4,660,819 | 4/1987 | Allocco, Jr. et al. | 271/3.1 |
| 4,844,440 | 7/1989 | Gray | 271/226 |

FOREIGN PATENT DOCUMENTS

| | | | |
|---|---|---|---|
| 75745 | 4/1986 | Japan | 271/248 |
| 61-197362 | 9/1986 | Japan | 271/220 |

OTHER PUBLICATIONS

Allen et al., Aligning Paper Tray, Feb. 1977, IBM Technical Disclosure Bulletin, vol. 19, No. 9.

*Primary Examiner*—H. Grant Skaggs
*Attorney, Agent, or Firm*—G. Herman Childress

[57] ABSTRACT

A mechanism registers a sheet of film and advances it toward an imaging station for exposure by a laser scanning system. A registration member is located along a surface that receives the sheet and the member is engageable by an edge of the sheet for registering and guiding the sheet toward the station. An urging guide located along another portion of the surface is skewed relative to the registration member and spaced from it so that the end portions of the guide and registration member nearest the station are spaced apart sufficiently to enable the sheet to lie flat on the surface while other portions thereof are sufficiently close together to prevent the sheet from lying flat on the surface. The guide projects above the surface and is tilted away from the registration member so that the guide imparts a component of force onto a sheet resting thereon which urges the sheet toward the registration member.

8 Claims, 3 Drawing Sheets

FIG. 1
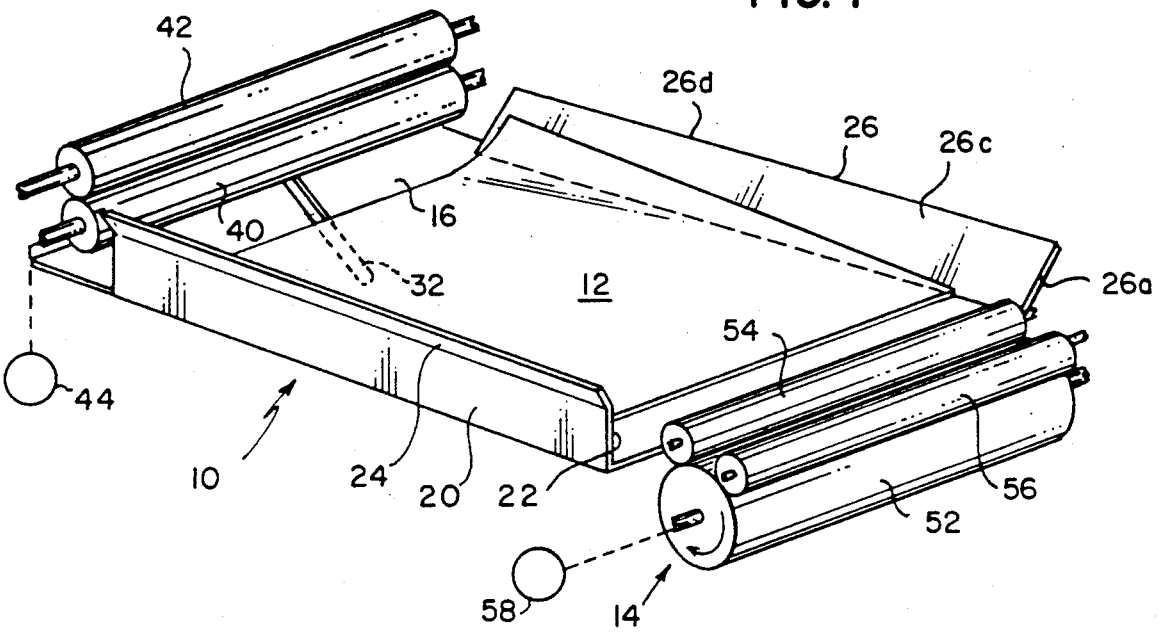
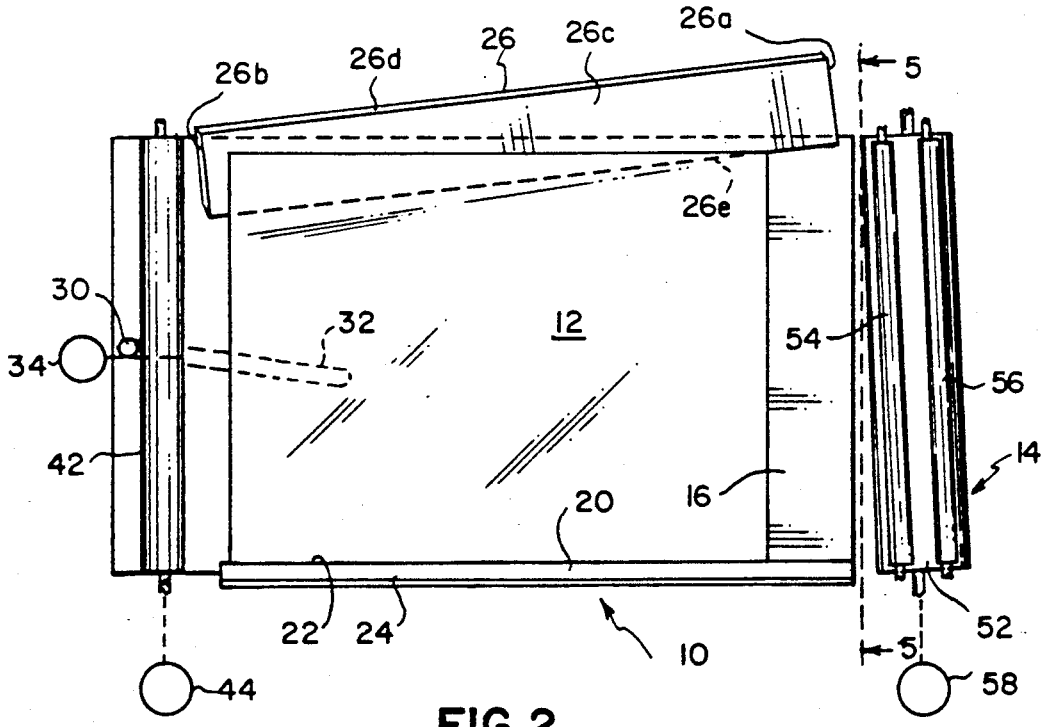
FIG. 2

FILM SHEET REGISTRATION MECHANISM

BACKGROUND OF THE INVENTION

The invention relates to a mechanism for registering a sheet relative to a station and, more specifically, to a registration mechanism particularly suitable for a sheet of film that is to be fed to an imaging station for exposure by a laser scanning system.

Sheet registration mechanisms of various kinds are known in the art. For example, U.S. Pat. No. 4,660,819, issued Apr. 28, 1987 in the names of C. Allocco et al, discloses a sheet registration device in a document handler of the kind used with electrographic copying apparatus wherein a set of document sheets are recirculated one or more times from the tray to a copying position and then returned to the tray. The handler of the patent has a tray surface on which sheets rest, and a sidewall or guide along one side edge of the tray surface terminates in an inclined ramp at the surface. A similar inclined ramp is provided on the other side of the tray. The two ramps are generally parallel to each other along opposite side edges of the tray. These ramps assist in registration of the document sheets in a corner of the tray prior to feeding of the sheets to the copying position.

Known sheet registration mechanisms may require a force other than gravity to be used for proper positioning of the sheet in the registration mechanism. In the above mentioned patent, for example, an air knife provides a jet of air which assists in locating the sheet on the tray surface. Also, known registration mechanisms require delivery of sheets to the mechanism from only one side, and such can limit the use of the mechanisms to specific kinds of apparatus.

SUMMARY OF THE INVENTION

It is an obJect of the invention to provide a sheet registration mechanism which utilizes the force of gravity for locating a side edge of a sheet in the registration mechanism. Another object of the invention is to provide a sheet registration mechanism which is simple and inexpensive, and which can accommodate sheets fed to the mechanism from more than one side thereof. A further object of the invention is to provide a sheet registration mechanism wherein a sheet can be driven along the mechanism toward a station at one velocity and then fed at a different velocity through the station without interference from the first feeding mechanism.

The present invention relates to a mechanism for registering a sheet relative to a station with the mechanism having a surface for receiving the sheet and the sheet being movable along the surface toward the station. The improvement of the invention comprises a registration member located along the surface and extending toward the station. The member is engageable by the sheet for guiding the sheet toward the station. An urging guide is located along the surface in spaced relation to the registration member. The guide is skewed relative to the registration member and spaced from the registration member so that end portions of the guide and member nearest the station are spaced apart sufficiently to enable the sheet to lie flat on the surface and other portions of the guide and member are sufficiently close together to prevent the sheet from lying flat on the surface. The guide projects above the surface and is tilted away from the registration member with the upper edge portion of the guide being further from the member than the lower edge portion of the guide so that the guide imparts a component of force onto the sheet urging the sheet toward the registration member.

The invention and its objects and advantages will become more apparent in the Detailed Description of the Invention presented below.

BRIEF DESCRIPTION OF THE DRAWINGS

In the Detailed Description of the Invention presented below, reference is made of the accompanying drawings, in which:

FIG. 1 is a perspective view of a film sheet registration mechanism of the present invention and showing a sheet on the mechanism;

FIG. 2 is a plan view of the registration mechanism shown in FIG. 1, with the sheet being in an initial position spaced from an imaging station;

DETAILED DESCRIPTION OF THE INVENTION

Figure 3:
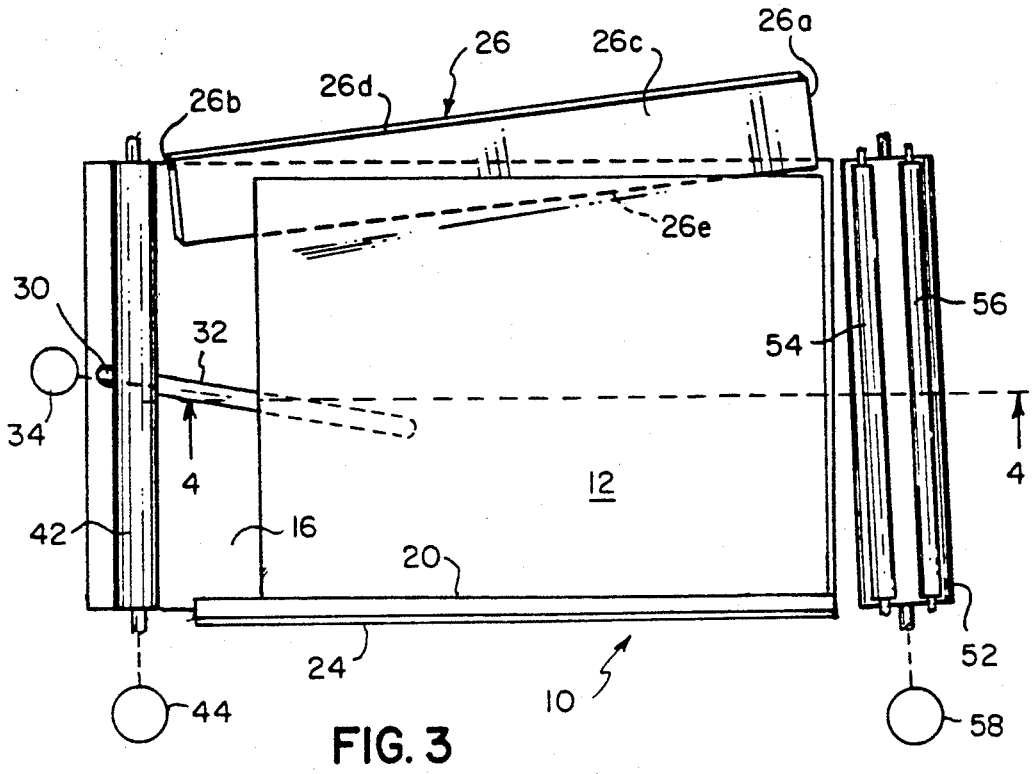
FIG. 3 is a view similar to FIG. 2 but illustrating the sheet nearer to the imaging station.

A registration mechanism of the invention is generally designated 10. The mechanism receives a sheet 12 and registers the sheet before the sheet is advanced to a station, such as an imaging station 14. The registration mechanism includes a platen 16 having a flat upper surface on which the sheet 12 is received. Preferably the surface of platen 16 is located in a substantially horizontal plane. Also, the platen is substantially rectangular in shape and slightly longer and wider than the dimensions of sheets 12 that are to be received by the registration mechanism.

A registration guide 20 is located along one side edge of the platen 16 and extends toward the station 14. Guide 20 has a vertical inner surface 22 that is substantially perpendicular to the upper surface of the platen 16. Sheets advanced along the platen engage surface 22 of the guide and are registered by this surface before entry into the station 14. Guide 20 has an upper edge portion 24 inclined outwardly away from the platen 16 so that a sheet being fed into the registration mechanism and which is offset from the desired location on the Platen 16 will be deflected onto the platen.

A second guide 26 also extends along the upper surface of platen 16 and is effective to urge a sheet on platen 16 toward surface 22 of guide 20. Guide 26 is spaced from the registration guide 20 and also is skewed relative to the guide 20. Guide 26 can be skewed at an angle of about 2½ degrees, for example. Guide 26 is located so that the end **26*a* of the guide nearest to the station 14 is spaced a greater distance from surface 22 of the guide 20 than the end 26*b* of guide 26. The distance between end 26*a* of guide 26 and the surface 22 is related to the width of the sheet 12 to be registered and, more specifically, the distance between the end portions of guides 26 and 20 nearest the station 14 is sufficient to enable the portion of the sheet therebetween to lie flat on the upper surface of the platen 16 before entering station 14. On the other hand, the end portion 26***b* of guide 26 is close enough to the surface 22 to prevent the sheet from lying flat on the surface in this area of the mechanism. Thus, the portions of the sheet located on the left end portion of platen 16 as viewed in the drawings are supported by guide 26.

Urging guide 26 is not only skewed relative to the registration guide 20, but it is also tilted away from the surface 22 of the guide 20. Thus, the surface 26*c* of guide 26 which faces the surface 22 of guide 20 also faces upwardly and extends above the surface of the platen 16. By way of example, surface 26 can be inclined at an angle of about 105 degrees relative to the surface of platen 16. Due to the tilting of the guide 26, the upper edge 26*d* of guide 26 is further from the surface 22 of guide 20 than is the lower edge 26*e* of guide 26. When a film sheet is delivered to the registration mechanism gravity urges the sheet against guide 26 and the skewed and tilting arrangement of guide 26 causes the guide to impart a lateral component of force onto the sheet 12. This resulting force moves and then holds the side edge of the film sheet against the surface 22 of the registration guide 20 to register the sheet for delivering to station 14. In addition, the spacing between the end 26*a* of the guide and the surface 22 enables the leading edge portion of the sheet to lie flat on the surface of the platen 16 prior to the time it enters the station 14.

Means are provided for moving a sheet 12 toward station 14. More specifically, the moving means illustrated in the drawings comprises a pusher cog 30 which projects upwardly through a slot 32 in platen 16 by a distance sufficient to engage the trailing edge of the sheet 12 on the platen. Slot 32 extends from a position adjacent the left edge of the platen, as viewed in FIGS. 1–3, toward station 14 by a distance that will permit movement of the leading edge of a sheet into a drive at station 14. Slot 32 is inclined toward the surface 22 of guide 20. By way of example, the slot 32 can be inclined at an angle of about 13 ° with respect to the guide surface 22.

The slot and cog are located relative to the length of the sheet 12 and relative to station 14 so that when the leading edge of the sheet reaches station 14 the cog is in engagement with the central portion of the trailing edge of sheet 12. For example, for sheets 11" wide cog 30 can be about 6"–7" from guide 20 when the cog is in its FIG. 2 position and about 5"–6" from guide 20 when the leading edge of the sheet reaches station 14. The slot can be parallel to surface 22 if sheets of only one width are to be handled, but preferably is inclined when sheets of a plurality of widths are to be handled, as described later relative to FIGS. 7 and 8.

The pusher rod is driven toward and away from the station by a drive mechanism, shown diagrammatically at 34 in FIG. 2. For example, the drive 34 can comprise a belt under platen 16 that is attached to the cog 30 with the belt being trained around a pair or rollers and driven by a reversible motor so that the cog is moved first toward the station 14 and then away from the station under control of a suitable machine control mechanism.

Sheets can be delivered to the platen 16 of the registration mechanism in any suitable manner. By way of example, FIGS. 1–3 illustrate a pair of entrance feed rollers 40,42 located adjacent the end of the platen 16 opposite from the station 14. One of these feed rollers, such as roller 40, can be driven from a suitable drive mechanism shown schematically at 44 in FIG. 1. The nip between rollers 40,42 is elevated above the surface of platen 16 and edge 26*d* of guide 26 so that sheets fed to the platen by the rollers pass over the cog 30 when it is in its retracted position and over guide edge 26*d*.

Figure 6:
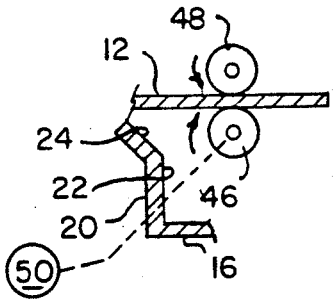
FIG. 6 is a fragmentary section illustrating feeding of sheets to the mechanism from a different side of the mechanism.
Figure 5:
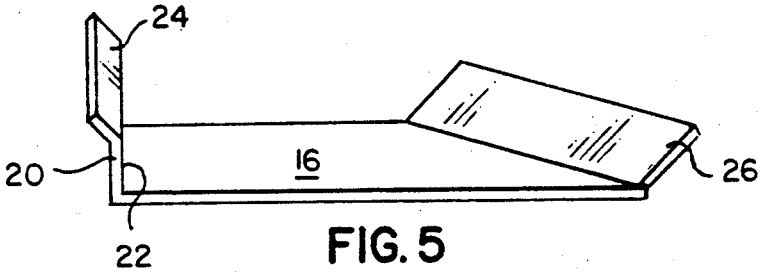
FIG. 5 is a transverse cross section taken along line 5—5 of FIG. 2 with the sheet being removed from the mechanism.

The feed rollers need not be located at the edge of the platen opposite from the station 14. For example, as shown in FIG. 6, feed rollers 46,48 can be located adjacent guide 20 with the nip between the rollers being above the upper edge of the registration guide 20. Roller 46 can be driven from a suitable drive mechanism 50. Sheets delivered to the registration mechanism by rollers 46,48 will rest on the upper surface of the platen 16 and surface 26*c* of the urging guide. Entrance feed rollers as shown at 40,42 and 46,48 could also be positioned along other edges of the registration mechanism.

Station 14 as illustrated in the drawings comprises a scanning station where an image can be formed on a sheet 12 of unexposed film such as x-ray film. Station 14 includes a scan drum or roller 52 and a pair of pinch/exit rollers 54,56. Roller 52 is driven from a suitable drive mechanism shown diagrammatically at 58 in FIG. 1. Rollers 54,56 both contact the surface of roller 52. Rollers 54,56 are spaced from each other and are effective to hold the portion of a sheet 12 located between the nips formed by rollers 52,54 and rollers 52.56 firmly against the surface of the larger roller 52. The image to be formed on the sheet can be projected onto the film through the narrow space between rollers 54,56.

Figure 4:
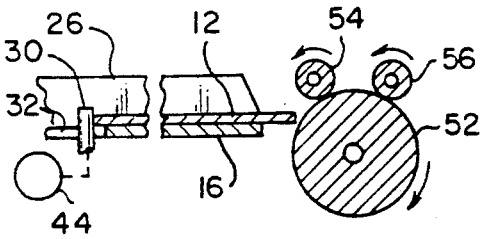
FIG. 4 is a fragmentary cross section view taken along line 4—4 of FIG. 3.

As best illustrated in FIG. 4, roller 52 is located with respect to the surface of platen 16 so that the leading edge of a sheet 12 advanced along the platen surface toward the rollers 52,54,56 engages the surface of roller 52 adjacent the nip defined by rollers 52,54 and before the sheet engages the roller 54. Because the sheet first contacts the surface of the larger roller 52, near the nip, it is guided by the roller surface into the nip between rollers 52,54. If the sheet engaged the smaller roller 54, first, it is more likely to be stubbed and deflected away from the nip between rollers 52,54.

Drive 58 for roller 52 preferably imparts a surface velocity to the roller 52 that is sufficiently high to effect the movement of the sheet 12 through the nip of rollers 52,54 and 52,56 at a velocity that exceeds the velocity imparted to the sheet by the cog 30 at the time the sheet enters the nip between rollers 52, 54. Because the scan drum speed is faster than the pusher cog speed, the drum will take the film and pull it away from the registration mechanism faster than it is being pushed by the cog 30. Thus the cog does not influence the movement of the film during the imaging operation.

Once the film has entered the nip between rollers 52,54, the cog can be stopped and returned to its home position as illustrated in FIG. 1. If the cog is returned to its FIG. 1 position during the scanning operation in station 14, it can cause vibrations which might adversely affect the quality of the image scanned onto the film. Accordingly, the cog preferably remains stationary during the time the film is being scanned in station 14, and then the cog is returned to its FIG. 1 position.

As best illustrated in FIGS. 2 and 3, the axis of rotation of rollers 52,54 and 56 are substantially parallel to each other. However, these axes are inclined relative to the surface 22 of guide 20, and thus the path of movement of a sheet toward station 14, so that the axes lie at an angle of slightly less than 90° to the surface 22. For example, for a set of rollers 52,54,56 about 14 inches long the nip defined by rollers 52,54 can be about 0.020 inches nearer the platen at the ends of the rollers remote from surface 22 than at the ends of the rollers nearest to the surface 22. As a result, a sheet being pushed across the surface of the platen 16 by the cog 30 will first enter the nip between rollers 52,54 at the upper edge of the sheet, as viewed in FIGS. 2 and 3 and prior to the entrance of the lower edge of the sheet into the nip. The faster drive imparted to the sheet by rollers 52,54 will have a tendency to pull the lower edge of the sheet slightly away from the registration surface 22 as the sheet is pulled through the scanning station 14. Thus once the sheet is being driven by rollers 52,54,56 the guiding function of the registration is complete, and the sheet is controlled solely by the rollers.

Operation of the sheet film registration mechanism of the invention will now be described. A sheet of film 12 to be registered and delivered to station 14 is fed to the registration mechanism 10 by feed rollers 40,42 or 46,48. The sheet is delivered onto the platen 16 with the trailing edge thereof spaced from cog 30 and with the leading edge thereof spaced from the station 14. The force of gravity pulls the sheet toward the surface of platen 16 and against the skewed, tilted surface 26*c* of guide 26 which produces a lateral component of force that urges the sheet toward the surface 22 of the registration guide. Then the cog 30 is driven to the right as viewed in FIGS. 1–3 and toward the guide 22. thereby urging the sheet toward guide 22 and simultaneously moving it into the station 14.

As the leading edge of the sheet enters station 14 it first contacts the surface of roller 52 adjacent to the nip between the rollers 52,54. Continued movement of the sheet brings it into the nip between rollers 52,54 with the upper edge of the sheet entering the nip first due to the slight inclination of rollers 52,54 and 56 relative to the leading edge of the sheet. The rollers 52,54 and 56 drive the sheet at a velocity that exceeds the velocity imparted to the sheet by cog 30 so that the sheet is pulled away from the cog and is controlled entirely by the rollers 52,54 and 56 as it moves through station 14. This enables scanning of the sheet film to take place with no influence from the cog 30.

Figure 7:
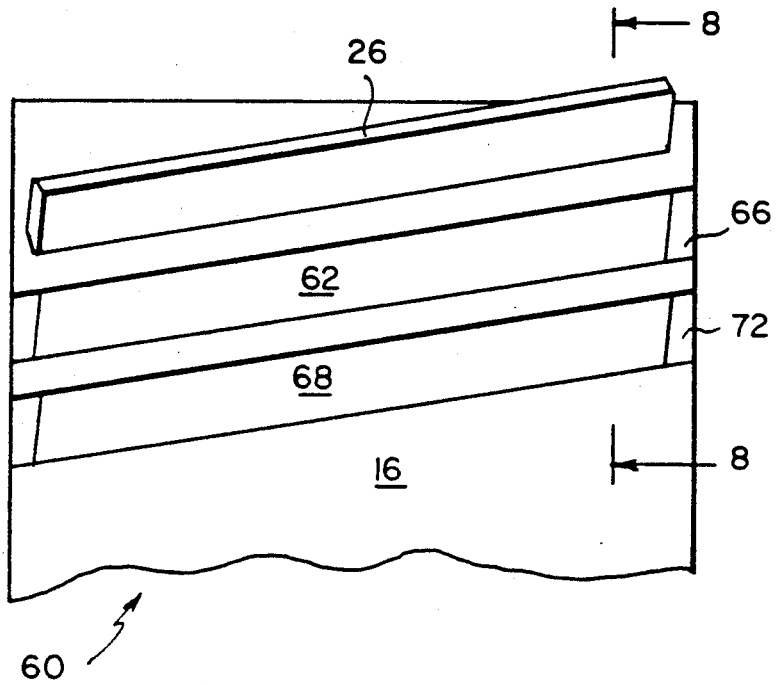
FIG. 7 is a fragmentary plan view of an embodiment of the invention with several different sizes.
Figure 8:
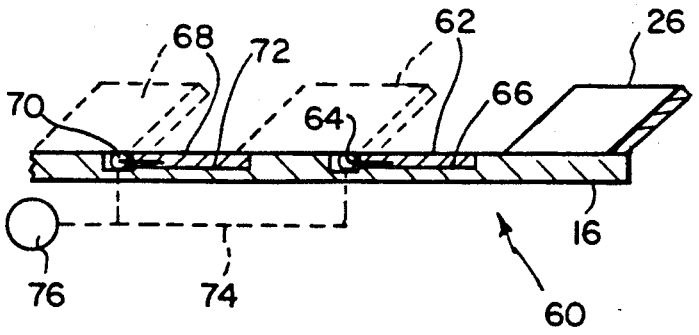
FIG. 8 is a cross section view taken along line 8—8 of FIG. 7 showing the urging guides of FIG. 7 in more detail.

At times it is desirable to use a registration mechanism of the invention for feeding film sheets of widely different dimensions to a station 14. For example, sheets of x-ray film are commonly available in sizes of 8×10 inches, 11×14 inches, 14×14 inches and 14×17 inches. The sheet registration mechanism generally designated 60 in FIGS. 7 and 8 is adapted to handle film sheets of such widely varying dimensions. In this embodiment of the invention the urging guide 26 is spaced from surface 22 of the registration guide by a distance such that it is capable of handling the widest sheet to be accommodated on the registration mechanism, such as sheets 14" wide.

A second urging guide 62 is provided for accommodating sheets of a narrower width, such as sheets that are 11" wide. Guide 62 is secured along its lower edge to a pivot 64 carried by platen 16. This enables the guide to be swung between a raised position and a lowered position. When in the raised position it is substantially parallel to guide 26 and located between the guide 26 and surface 22 above the surface of platen 16. When in its lowered position the guide is received within a recess 66 in the platen so that the upper surface of the guide lies in the same plane as the upper surface of the platen Thus when the guide is lowered, wider sheets (e.g., 14" wide sheets) can be accommodated on the platen and urged toward surface 22 by the urging guide 26. On the other hand, when the guide 62 is in its raised position somewhat narrower sheets (e.g., 11" wide sheets) can be accommodated on the registration mechanism and urged toward surface 22 by the upper surface of guide 62 in the same manner that the guide 26 urges sheets toward the surface 22.

In a similar manner, a third urging guide 68 is mounted on a pivot 70 for movement between a raised position above the surface of platen 16 and a lowered position in a recess 72 in the platen surface. When lowered the upper surface of the guide 68 lies in the same plane as the surface of platen 16, and it forms a smooth continuation of the surface of the platen. When guide 68 is raised it can urge the smaller of three sizes of sheets (e.g., 8" wide sheets) toward surface 22 in the manner explained before with respect to the guide 26.

Guides 62 and 68 can be raised and lowered manually by any suitable mechanism. As shown diagrammatically in the drawings, a linkage 74 can be connected to the pivots for the guides, or directly to the guides adjacent the pivots. The linkages can be driven to move the guides in an up and down direction by a suitable mechanism, such as a solenoid 76. Preferably, the moveable guides 62,68 are automatically raised or lowered to accommodate a particular size of sheet in response to a sensor (not shown) detecting the width of the sheet being delivered to the registration mechanism. Also, if one particular size of sheet is most frequently called for at the station 14, the control mechanism for the apparatus can have a default mode in which one or both of the guides 62,68 are in their lowered positions so that the mechanism is set for the size of film most often called for at station 14.

As discussed earlier, it is desirable for the cog 30 to engage the central portion of the trailing edge of the sheet when the leading edge reaches station 14. The slope of slot 32 enables this result to be achieved.

A number of advantages are achieved by the registration mechanism of the invention. First of all, a film sheet can be fed into the registration member from any of its sides, thus making it adaptable for use with apparatus of various kinds. The registration mechanism is not dependent upon the feed rollers used for delivering film to the registration mechanism, nor is it dependent on the use of rollers in the station 14 for withdrawing film from the station. The sheet becomes registered along the edge 22 of guide 20 due to the force of gravity urging the sheet downwardly and the inclined surface of the guide 26. This registration is assured by the inclination of the cog 30 toward the station 14, and by the slight tilting of the axes of the rollers in the station 14 relative to the surface 22 of the registration guide. Also, the invention can handle films of various dimensions by using movable urging guides 62,68 as shown in FIGS. 7 and 8. When sheets of several dimensions are received by the mechanism, the angle of slot 32 enables the cog to engage the central portion of the trailing edge of each size sheet as the leading edge reaches station 14.

The invention has been described in detail with particular reference to preferred embodiments thereof, but it will be understood that variations and modifications can be effected within the spirit and scope of the invention.

We claim:

1. In a mechanism for registering a sheet relative to a station, the registration mechanism having a surface for receiving a sheet with the sheet being movable along the surface toward the station, the improvement comprising:

a registration member located along the surface and extending toward the station, the member having an edge engageable by the sheet for guiding the sheet toward the station and aligning the sheet relative to the station, and an urging guide located along the surface in spaced relation to the registration member, the guide being skewed relative to the registration member and spaced from the registration member so that (1) end portions of the guide and member nearest the station are spaced apart sufficiently to enable the sheet to lie flat on the surface and (2) other portions of the guide and member are sufficiently close together to prevent the sheet from lying flat on the surface, and the guide projecting above the surface and being tilted away from the member, the guide having an upper edge portion and a lower edge portion with the upper edge portion of the guide being further from the member than the lower edge portion of the guide so that the guide imparts a component of force onto the sheet urging the sheet toward the registration member.

2. In a registration mechanism as set forth in claim 1, further comprising means for moving a sheet on the surface simultaneously toward the station and toward the registration member to assure registration of the sheet by the member as it is moved to the station.

3. In a registration mechanism as set forth in claim 2, further comprising first and second rollers at the station defining a nip for receiving a sheet advanced along the surface by the moving means, the first roller being larger in diameter than the second roller, the first roller being located with respect to the surface so that the leading edge of a sheet advanced along the surface toward the rollers engages the first roller adjacent the nip before entering the nip, and the first roller being a drive roller so that the rollers are effective to drive a sheet away from the surface.

4. In a registration mechanism as set forth in claim 3, wherein the rollers are effective to drive a sheet away from the surface at a velocity greater than the velocity imparted to the sheet by the moving means so that the sheet is advanced solely by the rollers after the leading edge of the sheet enters the nip between the rollers.

5. In a registration mechanism as set forth in claim 1, further comprising means for moving a sheet along the surface toward the station, the moving means being engageable with an edge of the sheet and being movable both toward the station and toward the edge of the registration member.

6. In a registration mechanism as set forth in claim 1, further comprising a second guide located between said urging guide and the registration member, means mounting the second guide for movement between (1) a raised position wherein the second guide projects the surface and (2) a lowered position wherein the second guide is substantially coplanar with the surface, and means moving the second guide between its raised and lowered positions so that sheets of a first size can be registered by the urging guide when the second guide is in the lowered position and sheets of a second and smaller size can be registered by the second guide when the second guide is in its raised position.

7. In a registration mechanism as set forth in claim 6 wherein the second guide when in its raised position is skewed relative to the registration member and tilted away from the registration member so that it is substantially parallel to the urging guide.

8. In a mechanism for registering a sheet relative to a station, the registration mechanism having a surface for receiving a sheet with the sheet being movable along the surface toward the station, the improvement comprising:

a registration member located along the surface and extending toward the station, the member being engageable by the sheet for guiding the sheet toward the station, and an urging guide located along the surface in spaced relation to the registration member, the guide being skewed relative to the registration member and spaced from the registration member so that (1) end portions of the guide and member nearest the station are spaced apart sufficiently to enable the sheet to lie flat on the surface and (2) other portions of the guide and member are sufficiently close together to prevent the sheet from lying flat on the surface, the guide projecting above the surface and being tilted away from the member, the guide having an upper edge portion and a lower edge portion with the upper edge portion being further from the member than the lower edge portion so that the guide imparts a component of force onto the sheet urging the sheet toward the registration member, means for moving a sheet on the surface simultaneously toward the station and toward the registration member to assure registration of the sheet by the member as it is moved to the station, and first and second rollers at the station defining a nip for receiving a sheet advanced along the surface by the moving means, the first roller being larger in diameter than the second roller, the first roller being located with respect to the surface so that the leading edge of a sheet advanced along the surface toward the rollers engages the first roller adjacent the nip before entering the nip, the first roller being a drive roller so that the rollers are effective to drive a sheet away from the surface, the rollers being effective to drive a sheet away from the surface at a velocity greater than the velocity imparted to the sheet by the moving means so that the sheet is advanced solely by the rollers after the leading edge of the sheet enters the nip between the rollers, the rollers being rotatable about substantially parallel axes, and the axes are inclined relative to the registration member at an angle less than 90° so that the portion of the leading edge of the sheet spaced from the registration member enters the nip before other portions of the leading edge.

* * * * *